United States Patent [19]

Ayer

[11] 4,067,575

[45] Jan. 10, 1978

[54] PLAYER FIGURE FOR A TABLETOP HOCKEY GAME

[76] Inventor: Jean Ayer, Baechlwies, 8184 Bachenbuelach, Switzerland

[21] Appl. No.: 699,274

[22] Filed: June 24, 1976

[30] Foreign Application Priority Data

June 30, 1975 Switzerland ..... 8504/75

[51] Int. Cl.[2] ..... A63B 71/00

[52] U.S. Cl. ..... 273/129 HA

[58] Field of Search ..... 273/129 HA, 129 HB, 273/87.2, 85 C, 87.4, 85 D, 119 R, 126 R; 124/7

[56] References Cited

U.S. PATENT DOCUMENTS

| | | | |
|---|---|---|---|
| 943,494 | 12/1909 | Venn | 124/7 |
| 1,785,876 | 12/1930 | Pilates | 124/7 |

FOREIGN PATENT DOCUMENTS

| | | | |
|---|---|---|---|
| 866,698 | 5/1941 | France | 273/129 HA |
| 271,064 | 1/1928 | United Kingdom | 273/29 HA |
| 693,766 | 7/1953 | United Kingdom | 273/29 HA |

*Primary Examiner*—William H. Grieb
*Assistant Examiner*—T. Brown
*Attorney, Agent, or Firm*—Behr & Woodbridge

[57] ABSTRACT

There is provided a figure for tabletop hockey games comprising the player figure and a spring loaded hockey stick attached thereto. Upon activation of said spring, said hockey stick moves in a manner simulative of a hockey stick in real play. The hockey stick is pivotally attached at a medral point thereof to the lower end of the arm of the player figure and spring biased to the player figure at the top thereof such that when the hockey stick is pivoted against the spring bias and its blade portion is placed near a ball or puck and the upper end of the stick is abruptly released, the ball or puck will be propelled over the playing surface.

4 Claims, 4 Drawing Figures

PLAYER FIGURE FOR A TABLETOP HOCKEY GAME

BACKGROUND OF THE INVENTION

1. Field of the Invention

This invention relates to a hockey game playing figure.

2. Description of the Prior Art

In certain tabletop football games, it is known to provide player figures wherein, upon pressure on an activating knob, a portion of said figure is caused to move forwardly in a manner simulative of the movement of a real player's leg so that the ball in said game may be caused to move. It would, therefore, be desirable to provide a player figure for ordinary or ice hockey wherein the ball or puck is caused to move by means of a hockey stick connected to the player figure in a manner simulative of the movement of a ball or puck in real play.

SUMMARY OF THE INVENTION

Briefly described, there is provided a player means for a game of tabletop hockey comprising a combination of a player figure and a hockey stick pivotally attached to said player figure. The hockey stick is activated by a spring means (either compressive or tensioned) so that upon activation of said spring means or the like, the lower end of the hockey stick is suddenly caused to move in a direction away from the foot portion of the player figure.

DESCRIPTION OF THE INVENTION

Figure 1:
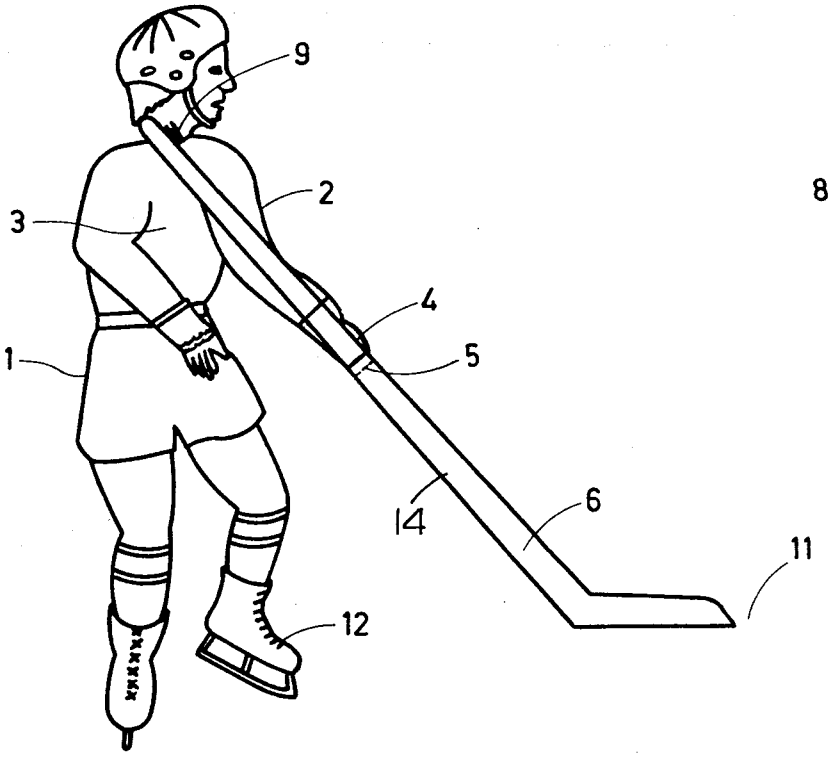
FIG. 1 shows a side elevational view of the player figure and hockey stick.

The device comprises a player figure 1 which is a representation of a player in hockey dress. The figure may be made, for example, of injected molded plastic or may be cut from a flat blank with the representation painted thereon. The manner of making the figure or the material from which it is made, provided that it is a substantially rigid material, is in no way to be considered a limiting factor in the present invention.

The figure 1 comprises, inter alia, a body portion 3, a foot portion 12, and two arm portions of which at least one arm 2, suitably the left arm, is directed downwardly and away from the body portion 2 of FIG. 1 in a manner similar to that in which a hockey player would orient his arm and hand when holding a hockey stick. It should be understood, of course, that while this is the more usual orientation of the hockey stick, the holding of the hockey stick in the right arm of the player is to be considered within the scope of the present invention.

There is further provided a U-shaped pivot means 4 located at the lower end of arm 2. Said pivot means 4 is made out of a rigid wire or the like and the plane thereof is substantially perpendicular to the principal vertical plane of FIG. 1. While it is generally preferred that the pivot be perpendicular to the plane of the figure, a certain amount of variation from this relationship is entirely permissable, and within the scope of the present invention.

The device further comprises a hockey stick 6 having a shaft portion 14 and a blade portion 11. Said shaft portion 14 has an opening 16 bored therethrough approximately halfway along its length. The loop portion 5 of pivot means 4 passes through the orifice 16 in shaft 14 whereby said shaft 6 is pivoted around an axis 7 at the end of loop means 5. Said axis 7 being parallel to the principal plane of FIG. 1.

Figure 2:
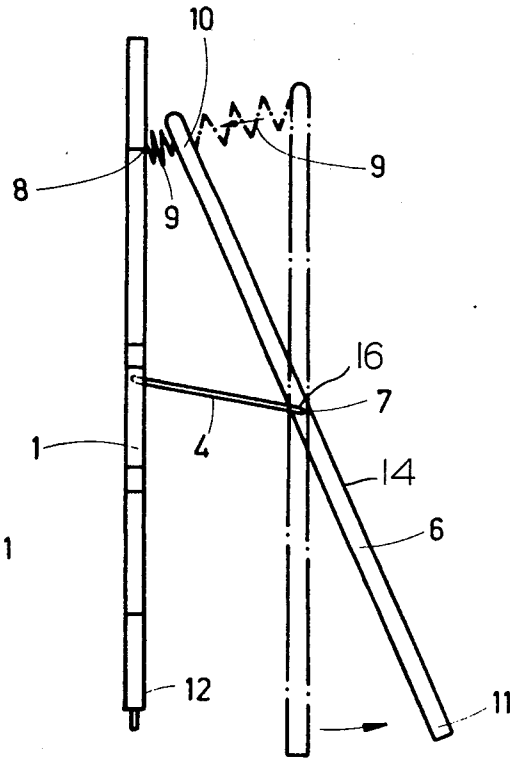
FIG. 2 shows an edgewise elevational view of FIG. 1 viewed from 2—2 showing the modification of the invention utilizing a tensioning means in the loaded and in the released position.

In one preferred modification of the invention as illustrated in FIG. 2 a tensioned spring means (or short rubber band 9 is attached at one end thereof to the upper end 10 of shaft 14 and the other end thereof is attached at point 8 located close to the neck portion of Player Figure 1. Thus, the tension provided by the spring or rubber band 9 holds the hockey stick 6 in the position shown by the fully lined illustration in FIG. 2 — namely, with blade end 11 away from the foot portion 12 of FIG. 1.

In order to utilize this figure and the stick attached thereto in simulating the game of hockey or ice hockey, a plurality thereof are placed upon a board laid out in simulation of a hockey field or ice hockey rink, and a ball or puck placed in the proximity of one of the player figures. In order to cause the ball or puck to move, the tensioning means 9 is placed under tension in the manner illustrated by the broken lines in FIG. 2 whereby the hockey stick 6 is placed in a substantially upright position. The lower end 11 of stick 6 is placed in proximity to the ball or puck and the upper end 10 of stick 6 is released. The tension in tensioning means 9 causes blade 11 to move sharply forward; thus, causing the ball or puck to be struck and moved in a manner simulative to that in a true game. game.

Figure 3:
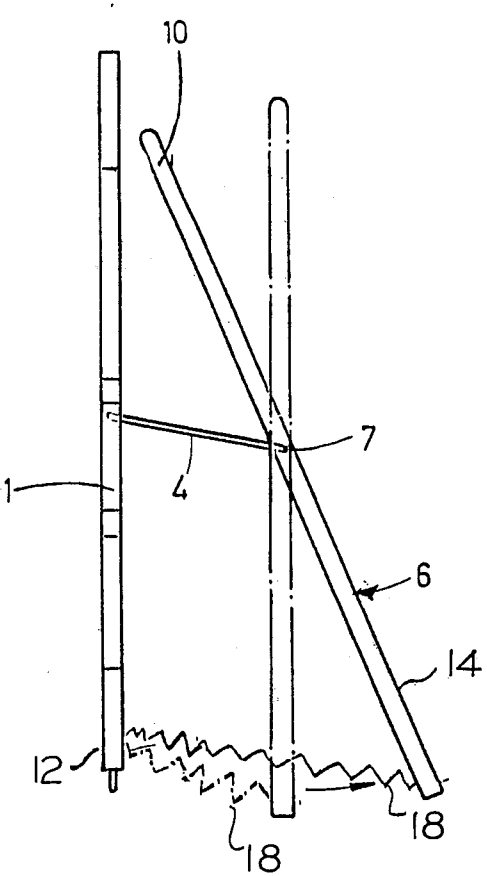
FIG. 3 shows a modification of the view of FIG. 2 utilizing a compressible spring means in the loaded and in the released position.

In the modification shown in FIG. 3 in place of a tension means located between point 8 on FIG. 1 and end 10 of stick 6, the same effect may be achieved by locating the compressible spring 18 between foot portion 12 of FIG. 1 and striking portion 11 of stick 6.

Figure 4:
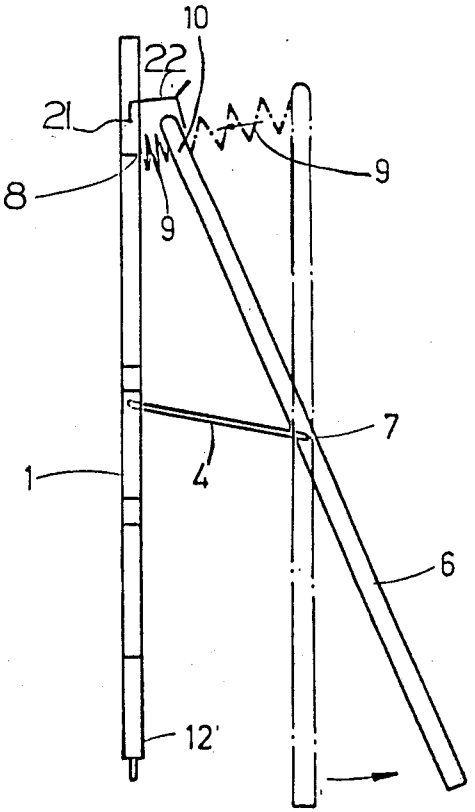
FIG. 4 shows a modification of the view of FIG. 2 additionally showing a catch release means.

As illustrated in FIG. 4 a catch means 22 is pivotally attached to body portion 3 by hinge means 21. The catch means 22 envelops end 10 of shaft 14 to hold the stick in the pre-play position. Upon moving catch means 22 in an anti-clockwise direction, the hockey stick is released to play as heretofore described.

I claim:

1. A playing piece for a tabletop hockey game comprising:

a player figure including a body portion;

at least one arm portion connected to said body portion and oriented outwardly and downwardly from said body portion;

a hockey stick including a shaft portion and a blade portion;

a pivot means, said pivot means having one end thereof rigidly affixed to the lower end of said arm portion and the other end thereof pivotally connected to said hockey stick; and, a spring means, said spring means being attached at one end thereof to the player figure and at the other end thereof to said hockey stick, said hockey stick being oriented in such a manner that the blade portion thereof is proximate to the foot portion of said player figure.

2. A player figure in accordance with claim 1 wherein said spring means is a tensionable spring means and wherein one end of said spring means is attached to the upper portion of the body portion of the player figure and the other end thereof is attached to the end of the shaft portion removed from the end to which the blade is attached.

3. A game piece in accordance to claim 1 wherein said spring means is a compressible spring means and is attached at one end thereof proximate to the foot portion of said player figure and the other end thereof is attached to the end of said shaft portion of said hockey stick near the point at which said shaft portion is joined to said blade portion.

4. A game piece according to claim 1 further including:

a means for holding said spring means in an activated state and for releasing said spring means in response to manual pressure.

* * * * *